United States Patent [19]

Berkeley

[11] Patent Number: 4,538,655

[45] Date of Patent: Sep. 3, 1985

[54] CUTTER HEAD SYSTEM

[75] Inventor: James E. Berkeley, Englewood, Ohio

[73] Assignee: Shopsmith, Inc., Dayton, Ohio

[21] Appl. No.: 623,901

[22] Filed: Jun. 25, 1984

[51] Int. Cl.[3] ..... B27G 13/00; B27C 1/14

[52] U.S. Cl. ..... 144/230; 144/117 R; 144/218; 409/228

[58] Field of Search ..... 145/4; 144/114 R, 117 R, 144/117 A, 117 B, 218, 230, 231, 229, 235, 236, 237; 409/175, 178, 181, 230, 228; 408/224, 225

[56] References Cited

U.S. PATENT DOCUMENTS

| | | | |
|---|---|---|---|
| 2,969,816 | 1/1961 | Johnsa | 144/117 R |
| 3,907,453 | 9/1975 | Bennett | 144/237 |
| 3,986,543 | 10/1976 | Slayton et al. | 144/237 |
| 4,353,400 | 10/1982 | Flanigan et al. | 144/117 R |

*Primary Examiner*—W. D. Bray

*Attorney, Agent, or Firm*—Biebel, French & Nauman

[57] ABSTRACT

A cutter head system for a woodworking tool in which one or a plurality of discrete cutter segments may be mounted on a shaft of a selected length to form a cutter head for either a jointer, a planer or a molding cutter. Each segment has a plurality of slot portions spaced about its outer periphery and is adapted to be mounted on a shaft so that the slot portions of ganged segments form continuous slots which are substantially coextensive with the segments. A plurality of blade members are positioned within and are coextensive with the slots, wedge plates are positioned within the slots for releasably securing the blade members against the cutter segments, and mounting screws urge the wedge plates against the blade members. Sets of blade members and wedge plates of varying length are used which correspond in length to the length of the slots formed by the segments. In a preferred embodiment, each cutter head includes screws at the base of the slots which may be adjustably positioned relative to the cutter head to support the blade members at an appropriate height.

13 Claims, 8 Drawing Figures

CUTTER HEAD SYSTEM

BACKGROUND OF THE INVENTION

The present invention relates to cutting tools and, more particularly, to cutter heads adapted to be rotatably driven by woodworking tools and mounting a plurality of blade members.

There are several types of woodworking tools designed specifically to shape a piece of wood stock so that its external surfaces are smooth, well-shaped and precisely angled to each other. One type of tool for performing such a function is a jointer. A jointer consists of a rotating cutter head positioned substantially below a workpiece-supporting surface. The supporting surface includes an infeed table, located upstream of the cutting tool, and an outfeed table, located downstream of the cutting tool and slightly above the infeed table.

The cutter head is motor-driven, cylindrical in shape, and rotates about an axis transverse to the direction of feed. The cutter head typically has between two and four blade slots formed in its outer surface and extending longitudinally of the cutter head. Each blade slot mounts a single cutter blade which is coextensive with the slot and typically is retained in the slot by a wedge which is screwed to the cutter head and urges the blade against a wall of the slot.

The cutter head is positioned such that the outer edges of the blades are at substantially the same elevation as the surface of the outfeed table. The blades of a typical cutter head for a jointer vary between 4" and 8" in length, and such a jointer is capable of making a depth of cut of not more than $\frac{3}{8}$". In operation, a fence is attached to the infeed and outfeed tables and the workpiece fed across the table so that the rotating cutter head makes a smooth cut at an angle to the fence. Jointers typically are used for making a smooth and straight edge on a board which is square to the face of the stock and is suitable for making a joint with another, similarly shaped piece of stock.

A planer is another type of woodworking tool which utilizes a rotating cutter head, but performs an operation which is different from a jointer. A planer has a level workpiece-supporting surface which is positioned beneath a motor-driven cutter head that rotates about an axis transverse to the direction of feed. The workpiece is fed across the table, and the rotating cutter head planes the stock to a uniform thickness. Planers are used to reduce thick boards to thinner ones, surface rough lumber, square up stock, plane boards to identical thicknesses, and even the thickness of boards that have been glued edge-to-edge.

The cutter head of a planer is similar in construction to its counterpart in a jointer, except that the length of the planer cutter head usually is two to three times that of the jointer: typically 8" to 12". An example of such a planer is shown in the Buttke U.S. Pat. No. 2,792,036. That patent shows a planer in which the cutter head consists of a unitary, cylindrical member having three longitudinally-extending blade slots. The blades are mounted within these slots and are held in position by wedges which include adjustable screws that extend outwardly to push against an opposite wall of the blade slot from the blade, thereby clamping the blade against the slot.

A third type of woodworking tool used to shape a piece of wood stock is a molding cutter. A molding cutter is used to shape table edges, form cabinet door lips, make sash, and produce strong glue joints. The cutter head for a molding cutter is similar to the cutter heads for jointers and planers in that it is generally cylindrical and includes slots shaped to receive cutting blades. However, the molding cutter head is rather short and disk-shaped in comparison, typically 1" to 2" in length, and the cutting blades may have arcuate or eccentrically-shaped cutting surfaces. The molding cutter head typically is used with a table saw assembly and is mounted on the shaft that normally holds the circular saw blade. The cutting blades project upwardly through a slot in the table, and the workpiece is guided over them. An example of a cutter head for such a tool is shown in the Edgemond, Jr. U.S. Pat. No. 2,896,678.

In the manufacture of jointers and planers, the most expensive component is the cutter head assembly, which includes the cutter head, blades and wedge mechanisms for attaching the blades to the cutter head. This is also true in the manufacture of multipurpose woodworking tools such as, for example, the tool shown in the Edgemond, Jr. et al. U.S. Pat. No. 2,927,612. That tool includes a motor-driven headstock adapted to power a number of different tools, among them a jointer and a molding cutter. It is also known to use a planer attachment which is adapted to be mounted on such multipurpose tools and driven by the motorized headstock.

Presently, a manufacturer of two or more of the aforementioned cutting tools, or a manufacture of a multipurpose woodworking tool having two or more of the cutting tools, must manufacture a specific cutter head for each type of cutting tool. The necessity of having to manufacture several types of cutter heads adds a significant expense to the overall cost of production for that manufacturer. There presently is no single cutter head in use which can be adapted to be used with either a jointer, a planer or a molding cutter.

Accordingly, there is a need for a cutter head system which is capable of being modified to function as a cutter head for a jointer, planer or molding cutter. However, such a cutter head system should be sufficiently precise to provide the relatively close cutting tolerances required of such woodworking tools.

SUMMARY OF THE INVENTION

The present invention is a cutter head system comprising a plurality of cutter segments shaped to be mounted on a shaft and which can be used singly to function as a molding cutter head, or ganged together on a common shaft to form a cutter head for a jointer or a planer. The system includes elongate shafts of selected lengths, each having an end adapted to be attached to a driving coupling, a plurality of cutter segments, each having a plurality of slot portions spaced about its outer periphery, and a central bore adapted to slidably receive one of the shafts.

When two or more cutter segments are mounted on a selected shaft, their slot portions form continuous slots which are substantially coextensive with the aligned cutter segments. The system includes a plurality of sets of blade members, each set corresponding in length to one or a combination of segments. The blade members of a set are positioned within and are coextensive with the slots, and are clamped to the cutter head by wedge plates held within the slots by screws.

In a preferred embodiment, both the shafts and the bores of the cutter segments are hexagonally shaped in cross section. The engagement of a hexagonal shaft with the mating bores of the cutter segments serves the dual purpose of preventing rotation of the cutter segments relative to the shaft and properly positioning the cutter segments relative to each other so that their slot portions align accurately to form continuous slots for receiving the blade members.

Also in the preferred embodiment, the blade members are wedge-shaped, tapering in thickness toward their cutting edges. The blades are positioned within the blade slots so that a flat face of the blade rests against a wall of the slot. A continuous wedge plate is placed against an opposite face of the blade and held in position by a plurality of screws which are threaded through the segments comprising the cutter head, thereby clamping the blade between the wall of the slot and the wedge plate.

In order to secure a cutter head made of two or more segments to its shaft, the end segments are provided with set screws which are threaded through the segments to engage the shaft on which they are mounted. The threaded bores that receive the set screws are positioned at an angle to the adjacent face of the hexagonal shaft, so that, when the set screw is urged against the shaft, the segment is rotated slightly relative to the shaft rather than being displaced slightly off center. This engagement maintains the concentricity of the cutter segments relative to the axis of rotation of the shaft. In addition, by securing only the end segments of the cutter head, the other segments are aligned automatically by their attachment to the blade members and wedge plates.

A principal advantage of the cutter head system of the present invention over prior art cutter heads used either for jointers, planers or molding cutters is that the length of the cutter head made by the invention can be varied by utilizing a single cutter segment, or groups of cutter segments to form composite blade-receiving slots of the desired length. Blade members and wedge plates of the appropriate length are then attached to the ganged cutter segments within the composite slots.

By utilizing the cutter head system of the present invention, a manufacturer of cutting tools need not make a specific cutter head for each type of tool. Rather, such a manufacturer may use the cutter head system to form a cutter head for a molding cutter by mounting one segment on a shaft, a jointer by mounting two segments on a shaft, or a planer by mounting three to six segments on a shaft. Of course, the lengths of the shafts and blades selected will correspond to the number of segments utilized. It has been estimated that the use of such a cutter head system by a manufacturer of cutting tools will result in a manufacturing cost that is 30% less than the cost of manufacturing specific cutter heads for each type of tool.

Accordingly, it is an object of the present invention to provide a cutter head system comprising a plurality of cutter elements that may be used singly or ganged on a common shaft to provide a jointer, planer or molding cutter; a cutter head system which is relatively inexpensive to manufacture and yet mounts cutting blades with a high degree of precision; a cutter head system in whih a plurality of cutter elements are fixed to a common shaft such that their concentricity relative to the shaft is maintained; and a cutter head system comprising a plurality of cutter elements ganged on a common shaft which maintain their alignment when supporting commonly held blade members.

Other objects and advantages of the invention will be apparent from the following description, the accompanying drawings and the appended claims.

DETAILED DESCRIPTION OF THE PREFERRED EMBODIMENTS

Figure 1:
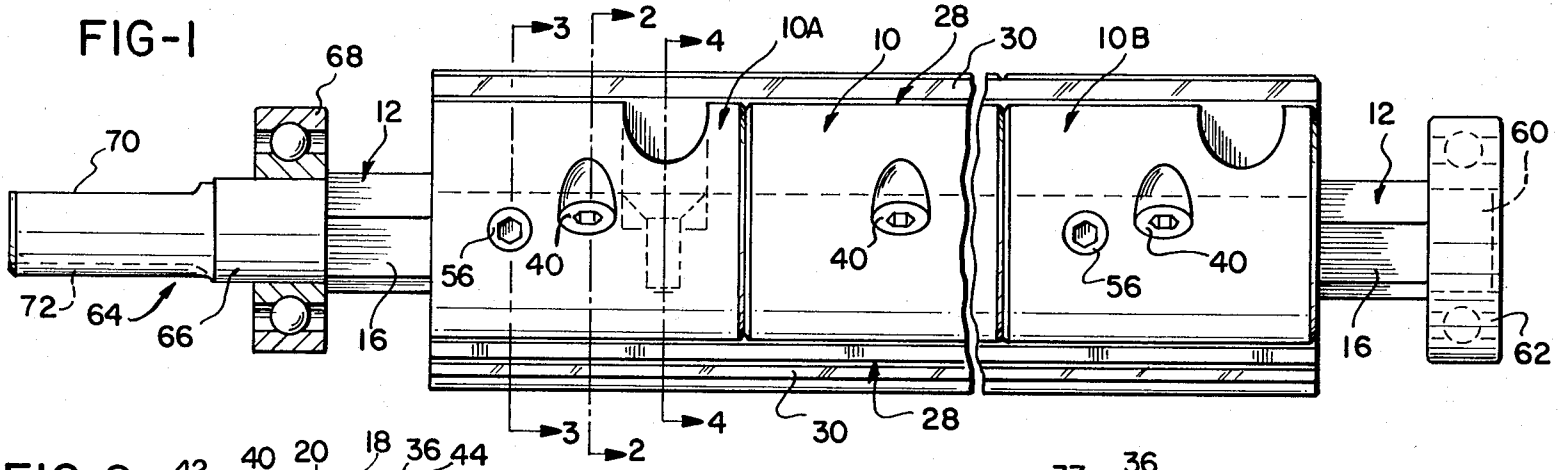
FIG. 1 is a side elevation of a cutter head showing a preferred embodiment of the invention adapted for use in a planer, and having a portion partially broken away.
Figure 2:
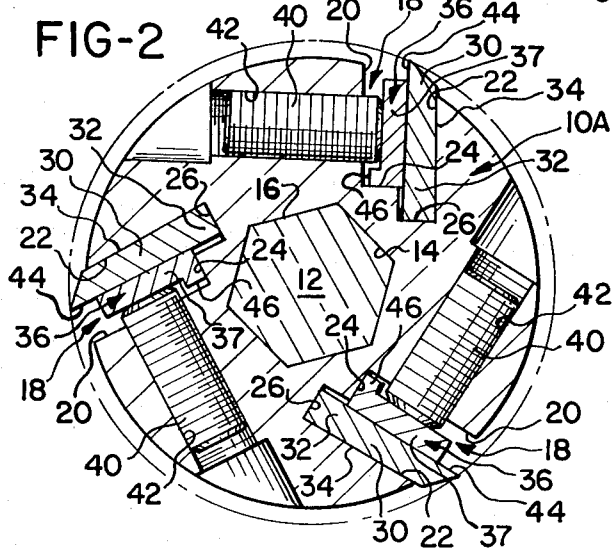
FIG. 2 is a side elevation in section of the cutter head taken at line 2—2 of FIG. 1.

FIGS. 1 and 2, show a preferred embodiment of the cutter head system of the present invention adapted for use in a planer. This cutter head includes a plurality of cutter segments 10 mounted on a common shaft 12. Each of the cutter segments 10 includes a hexagonal bore 14 through its center which is shaped to matingly engage the hexagonal outer surface 16 of the shaft 12. The cutter segments 10 are substantially cylindrical in shape and each includes three slot portions 18 formed about its outer surface and extending parallel to the bore 14.

Each slot portion 18 includes a pair of opposing walls 20, 22 and stepped floor surfaces 24, 26. The slot portions 18 are formed in the cutter segments 10 relative to the hexagonal bores 14 so that they form continuous slots 28 when the cutter segments are ganged on the shaft 12 (see FIGS. 6 and 8).

Figure 3:
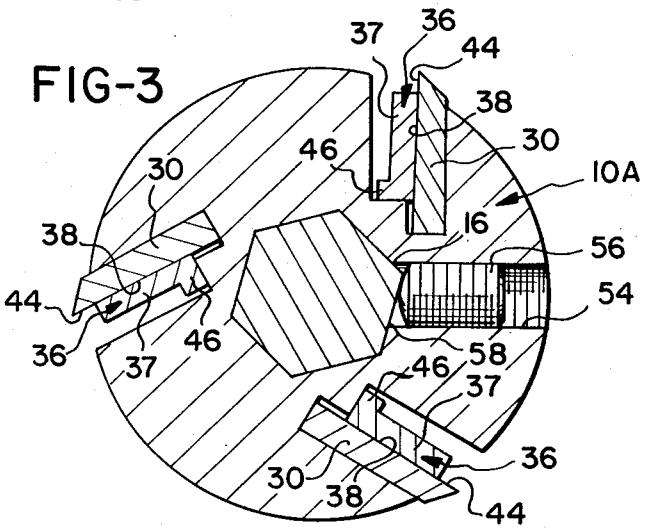
FIG. 3 is a side elevation in section of the cutter head taken at line 3—3 of FIG. 1.

Each of a set of elongate blade members 30 is positioned in one of the continuous slots 28. Each blade member 30 includes a base 32 positioned adjacent the floor surfaces 26 of the cutter segments 10, and a side edge 34 positioned adjacent the walls 22 of the segments. As shown in FIGS. 2 and 3, each blade member 30 is attached to the cutter segments 10 by one of a corresponding set of wedge plates 36, the head portions 37 of which are urged against side edges 38 of the blade members by allen screws 40. Allen screws 40 are threaded through threaded bores 42 formed in each of the cutter segments 10. The sets of blade members 30 and wedge plates 36 each have a length substantially the same as slots 28.

The blade members 30 taper in thickness from their bases 32 to their cutting edges 44, and the threaded bores 42 are oriented such that the allen screws 40 are positioned perpendicularly to the side edges 38 of the blade members. Therefore, the screws 40 are nonperpendicular to the opposing walls 20, 22 of the slots. This positioning of the allen screws 40 helps to clamp the blade members 30 within the slots 28 and prevent the inadvertent removal of the blade members from the cutter segments 10 during operation. As shown in FIGS. 2 and 3, the wedge plates 36 include feet 46 which rest upon the floor surfaces 24 of the cutter segments 10. The stepped floor configuration made by the floor surfaces 24, 26 maintains the wedge plates 36 and blade members 30 in position when the allen screws 40 are backed away from the wedge plates, as during insertion or removal of the blade members. The feet 46 of the wedge plates 36 are sized to engage the ends of the allen screws 40 when the screws are backed away for blade insertion or removal and therefore prevent the wedge plates from inadvertently falling out of the slots at those times.

Figure 4:
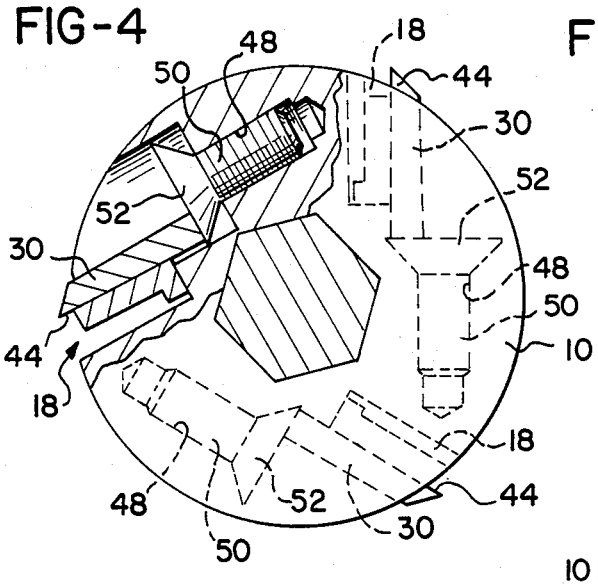
FIG. 4 is a side elevation in section of the cutter head taken at line 4—4 of FIG. 1.

As shown in FIG. 4, each cutter segment 10 includes a countersunk, threaded bore 48 which intersects each of the slot portions 18 and receives a screw 50 having a flared head 52. The screws 50 can be threaded into or backed out of their respective bores 48 to provide an adjustable supporting surface for the adjacent blade members 30, so that the cutting edges 44 of the blade members are maintained parallel to the axis of rotation of the supporting shaft 12.

As shown in FIGS. 1 and 3, the cutter segments 10A, 10B, which form the ends of the composite cutter head, each include a threaded bore 54 which receives a set screw 56 that is urged against the hexagonal portion 16 of the shaft 12. The bore 54 is oriented at a nonperpendicular angle to the adjacent face 58 of the shaft 12 so that the force exerted against the shaft as the screw 56 is tightened tends to rotate the cutter segments 10A, 10B relative to the shaft rather than merely displacing those cutter segments relative to the shaft.

The advantage of this arrangement is that the cutter segments 10A, 10B remain concentric relative to the axis of rotation of the shaft when tightened against it, rather than being displaced slightly from the axis of rotation to a nonconcentric position, which would happen if the set screw 56 were oriented perpendicularly to the face 58. The intermediate segments 10 (FIG. 1) of the composite cutter head do not have the mounting screws 56 of the cutter segments 10A, 10B. They are maintained in alignment with the end segments 10A, 10B by their engagement with the blade members 30 and wedge plates 36, which are substantially coextensive with continuous slots 28. Thus, the intermediate cutter segments 10 are self-aligning relative to the end segments 10A, 10B.

As shown in FIG. 1, the shaft 12 includes an outer end 60 which is rounded and receives outer support bearings 62 which are press-fitted onto the end and are of well-known design. The inner end 64 of the shaft 12 includes a rounded portion 66 which receives inner support bearings 68. The inner end 64 also includes a portion having a flat 70 and key slot 72 which are shaped to be connected to the driving coupling of an electric motor (not shown) of well-known construction.

Figure 5:
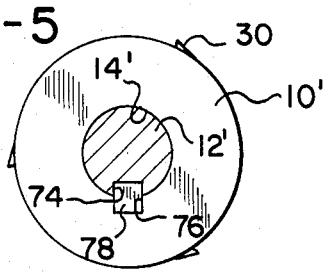
FIG. 5 is a side elevation in section of an alternate embodiment of the invention.

An alternate embodiment of the invention is shown in FIG. 5. In this embodiment, the construction of the cutter segments 10′ (only one of which is shown), blade members 30 and wedge plates is substantially identical to the embodiment of FIGS. 1–4. However, the supporting shaft 12′ is round in cross section and includes a key slot 74. The cutter segments 10′ include round bores 14′ having mating key slots 76, and are positioned on the shaft 12′ so that the key slots 74, 76 are in registry and receive keys 78. With this embodiment, the end segments of the cutter head are retained on the shaft 12′ by conventional snap rings (not shown), rather than by the mounting set screw 56 shown in FIG. 3.

Figure 8:
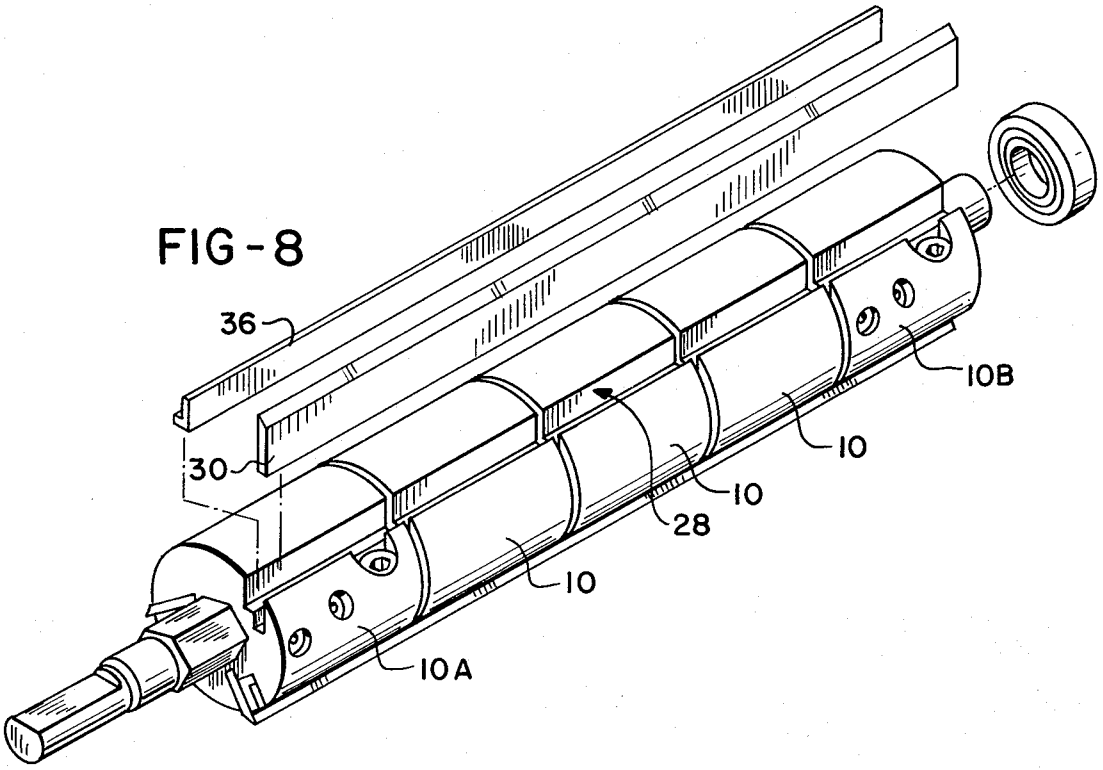
FIG. 8 is a perspective, partially exploded view of the invention modified to form a planer cutter head.

The cutter head shown in FIGS. 1 and 8 is adapted for use in a motor-driven planer and, although five segments 10A, 10, 10B are shown, typically could include from four to six cutter segments, each having a length in an axial direction of approximately 2″, so that the effective length of the cutter head would be from 8″ to 12″. Accordingly, the sets of blade members 30 and wedge plates 36 would be approximately 12″ in length to provide continuous cutting blades for the planer.

Figure 6:
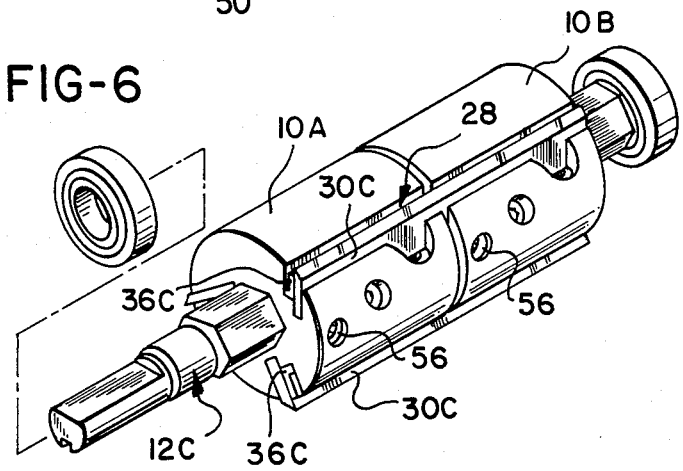
FIG. 6 is a perspective, partially exploded view of the invention, modified to form a jointer cutter head.

The cutter head can be modified to the configuration shown in FIG. 6 in which only two cutter segments 10A, 10B are mounted on a correspondingly shortened shaft 12C. It should be noted that, with this configuration, the segments each include mounting set screws 56 shown in FIG. 3. The cutter head configuration shown in FIG. 6 is appropriate for use in a jointer device and would use sets of blade members 30C and wedge plates 36C of approximately 4″ in length to provide continuous cutting edges.

Figure 7:
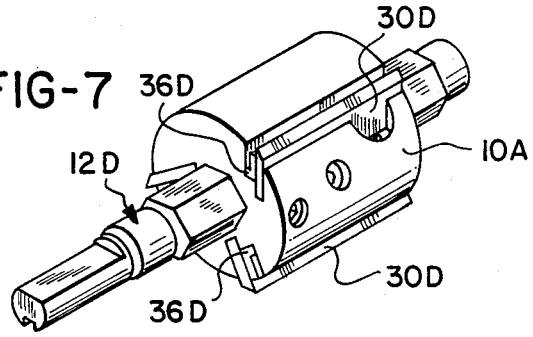
FIG. 7 is a perspective view of the invention modified to form a molding cutter head.

The configuration shown in FIG. 7 is a modification of the invention to provide a cutter head for use with a molding cutter. A single cutter segment 10A is mounted on a shaft 12D which is correspondingly shortened in length and would use sets of blades 30D and wedge plates 36D which are approximately 2″ in length.

As shown in FIGS. 6, 7 and 8, the cutter head of the invention provides a modular system in which a single cutter segment can be mounted on a supporting shaft, or a plurality of cutter segments ganged on a common shaft to form cutter heads to support sets of blades of virtually any length. Therefore, a manufacturer of a number of related woodworking tools need no longer manufacture separate cutting heads for jointers, planers and molding cutters. Rather, such a manufacturer need only produce supporting shafts, blade members and wedge plates of the appropriate length.

In the preferred embodiment, the cutter head segments are made of sintered metal. The wedge plates are made of hardened 1018 steel, and the blade members are made of hardened alloy steel of a type typically used for cutting blades of woodworking tools. The supporting shaft for both embodiments is preferably made of standard bar stock.

While the forms of apparatus herein described constitute preferred embodiments of this invention, it is to be understood that the invention is not limited to these precise forms of apparatus, and that changes may be made therein without departing from the scope of the invention.

What is claimed is:

1. A cutter head system adaptable to a plurality of woodworking tools, comprising:

an elongate shaft having an end adapted to be attached to a driving coupling;

a plurality of cutter segments, each having a plurality of slot portions spaced about an outer periphery thereof and a central longitudinal bore adapted to slidably receive said shaft therethrough;

means for preventing rotation of said cutter segments relative to said shaft and to each other, and for aligning said cutter segments along said shaft such that said slot portions form continuous slots substantially coextensive with said aligned cutter segments;

a plurality of blade members, each positioned within and coextensive with a different one of said continuous slots; and means for releaseably securing said blade members within said slots.

2. The cutter head system of claim 1 wherein said blade members taper in thickness from a base thereof to a cutting edge thereof; and said securing means includes wedge means positioned within said slots adjacent to said blade members.

3. The cutter head system of claim 1 wherein said rotation preventing means comprises said shaft having a polygonal contour in cross section; and said central bores of each of said segments having mating polygonal contours in cross section.

4. The cutter head system of claim 1 wherein said rotation preventing means comprises said shaft having a longitudinal key slot along an outer surface thereof; said bores including mating key slots therealong; and an elongate key shaped to engage said key slot and said mating key slot.

5. The cutter head system of claim 2 wherein said wedge means comprises a plurality of wedge plates, each positioned within a different slot and coextensive with an adjacent one of said blade members; and screw means threaded through said segments and having ends projecting into said slots and urging against said wedge plates, thereby clamping said blade members between said wedge plates and said cutter segments.

6. The cutter head system of claim 5 wherein each of said wedge plates includes a substantially flat head portion abutting an adjacent one of said blade members along a side thereof; and a foot raised from said head portion and extending along a lower edge and on an opposite side thereof below said projecting ends of said screw means, such that said wedge plates and blade members remain fixed within said slots should said screw means become loosened from said wedge plates yet still project into said slots sufficiently to engage said feet.

7. The cutter head system of claim 6 further comprising means for fixing said segments to said shaft to prevent relative sliding movement therebetween.

8. The cutter head system of claim 7 wherein said fixing means includes a plurality of set screws threaded through ones of said segments adjacent ends of said shafts and projecting into said bores thereof to engage said shaft at nonperpendicular angles thereto.

9. The cutter head system of claim 8 further comprising a plurality of said shafts, each corresponding in length to one or a multiple of said cutter segment lengths; a plurality of sets of said blade members, said members of each of said sets corresponding in length to one of said continuous slots formed by said one or a multiple of said cutter segments; and a plurality of sets of wedge plates, said plates of each of said sets corresponding in length to said members of one of said sets of blade members.

10. A cutter head system adaptable to a plurality of woodworking tools, comprising:

a plurality of shaft means, each having a different, predetermined length;

a plurality of cutter segments, each of said segments having a central bore sized to receive said shaft means therethrough and a length such that one of said segments may be mounted on one of said shaft means having a corresponding length, or a selected number of said segments may be ganged on one of said shaft means of a corresponding length;

said segments each having a plurality of longitudinally extending slot portions spaced evenly about an outer periphery thereof such that said slot portions of ganged ones of said segments form a plurality of continuous slots therealong;

a plurality of sets of blade members, each of said sets having blade members corresponding in length to a different one of said slots of one or a selected number of said ganged segments;

means for releaseably securing said blade members within said slots; and means for nonrotatably attaching said segments to said shafts.

11. The cutter head system of claim 10 wherein said securing means includes a plurality of sets of wedge plates, each of said sets corresponding in length to one of said sets of blade members.

12. The cutter head system of claim 10 wherein said attaching means includes said shafts having a polygonal shape in cross section; and said bores of said segments have cross sections matingly shaped thereto.

13. A cutter head system adaptable to a plurality of woodworking tools, comprising:

a plurality of elongate shafts, each having a different, predetermined length, a hexagonal shape in cross section and an end adapted to be attached to a driving coupling;

a plurality of cutter segments adapted to be mounted singly or in abutting relation on a selected one of said shafts, each of said segments having a generally cylindrical shape, a concentric bore having a hexagonal contour in cross section shaped to matingly receive a selected one of said shafts therethrough, thereby preventing rotation therebetween, and a plurality of longitudinally extending slot portions spaced evenly about an outer periphery of said segment and coextensive therewith, said slot portions oriented parallel to said bore and positioned on each side of said segments to form continuous slots extending substantially an entire collective length of said cutter segments, said collective lengths of combinations of said cutter segments corresponding to said lengths of said shafts;

a plurality of sets of blade members, each of said sets corresponding in length to a combined length of a selected number of said segments, each blade element tapering in thickness from a base to a cutting edge thereof and sized to fit within and extend substantially an entire length of one of said slots;

a plurality of sets of wedge plates, each of said wedge plate sets corresponding in length to one of said blade sets, each of said wedge plates of a selected set positioned within and extending substantially an entire length of one of said slots, and including a subsantially flat head portion abutting an adjacent one of said blade members along a side thereof, and a foot raised from said head portion and extending along a lower edge thereof;

a plurality of set screws threaded through said segments and having ends projecting into said slots above said lip portions such that said screws may be advanced toward said wedge plates to urge said wedge plates to clamp said blade members against said cutter segments, and said foot portions engage said screw ends to prevent removal of said blade members and said wedge plates from said slots should said screws become loosened from said wedge plates yet still project a predetermined distance into said slots.

* * * * *